United States Patent [19]

Zollinger et al.

[11] Patent Number: 4,901,769

[45] Date of Patent: Feb. 20, 1990

[54] TUCK-IN NEEDLE FOR A SELVAGE FORMING DEVICE

[75] Inventors: Hans Zollinger, Tann-Ruti; Mario Tamaro, Rüti, both of Switzerland

[73] Assignee: Sulzer Brothers Limited, Winterthur, Switzerland

[21] Appl. No.: 345,978

[22] Filed: May 1, 1989

[30] Foreign Application Priority Data

Apr. 29, 1988 [CH] Switzerland ..... 01612/88

[51] Int. Cl.[4] ..... D03D 47/48

[52] U.S. Cl. ..... 139/434

[58] Field of Search ..... 139/429, 434

[56] References Cited

U.S. PATENT DOCUMENTS 4,715,410 12/1987 Griffith ..... 139/434

FOREIGN PATENT DOCUMENTS 0134377 3/1985 European Pat. Off. .
0149969 7/1985 European Pat. Off. .
1522148 4/1968 France .
2322950 4/1977 France .
0472519 6/1969 Switzerland .

*Primary Examiner*—Henry S. Jaudon
*Attorney, Agent, or Firm*—Kenyon & Kenyon

[57] ABSTRACT

The tuck-in needle of a mechanical selvedge-forming device has a catcher for a yarn end following a needle tip. The catcher is subdivided into an entry zone and a trough screened from the entry zone by a hook disposed towards the trough. In its catching movement the needle is moved only towards the weft yarn so that the yarn moves into the entry zone of the catcher. The weft yarn then slides inclinedly over the outside of the hook until passing by way of the hook tip into the catcher interior. The weft yarn can be drawn into the cloth selvedge in this position. This construction enables the tucking-in to be very simple.

14 Claims, 9 Drawing Sheets

20
21
5
5'
4
4'
54'
34
32
33'
31
30
61
25
26
60
22'
66
23
22
a,d
c
e
b
64
22''
54
22'''
56
55
55'
53
63
29
67
62
27
24
23'
d'
e'
c'
b'
a'

TUCK-IN NEEDLE FOR A SELVAGE FORMING DEVICE

This invention relates to a tuck-in needle for a selvage forming device for a loom. More particularly, this invention relates to a selvage forming device for a loom.

As is known, various types of mechanical selvage-forming devices have been used in looms for the tucking in of a weft yarn into a shed of warp yarns to produce a selvage. In this respect, tucking in of the weft yarn end which projects beyond a cloth edge produces a firm selvage necessary for the further processing of the woven cloth. However, in most cases, the known mechanical selvage-forming devices have a complex drive mechanism which comprises a large number of moving parts.

U.S. Pat. No. 3,499,474 describes a mechanical selvage forming device which employs a conventional hook needle for tucking-in a weft yarn end. However, the needle has a complex movement pattern. Further, if the selvage-forming device is to attain a high operating frequency, the driving mechanism for the device must be elaborate.

Accordingly, it is an object of the invention to provide a mechanical selvage-forming device of relatively simple construction.

It is another object of the invention to provide a mechanical selvage-forming device which operates using simple movements.

It is another object of the invention to provide a relatively low cost selvage forming device for a loom.

Briefly, the invention provides a selvage-forming device for a loom which utilizes a tuck-in needle having a tip on one flank for passing into a space between two adjacent warp yarns and a catcher for a weft yarn upstream of the tip. The catcher is constructed to have an entry zone for initially receiving a weft yarn, a trough for receiving the weft yarn from the entry zone and a hook extending towards the trough to screen the trough from the entry zone.

The tuck-in needle must, when making a catching movement, so move relative to the weft yarn that the yarn reaches the catcher entry zone which may be funnel-shaped to facilitate weft yarn entry. The weft yarn then slides inclinedly over the outside of the hook until passing over the tip of the hook into the interior of the catcher, that is, into the trough. Thereafter, the weft yarn is drawn in this position into a shed formed by a plurality of warp yarns and is thereafter able to slide out of the laterally open catcher. The construction of the needle tip greatly simplifies the movement pattern of the tuck-in needle during the catching and tuck-in operation. A device of this kind can operate at a higher frequency than a device such as described in U.S. Pat. No. 3,499,474.

In one embodiment, the tuck-in needle is mounted on a shaft which is able to rotate about an axis parallel to the direction of warp yarns in the shed so as to move into and out of the shed. In addition, the shaft is movable longitudinally in parallel relation to the warp yarns so as to permit the inserted needle to engage a weft yarn end outside of the shed.

In another embodiment, the selvage forming device employs a yarn clamp for holding the weft yarn in angular relation to the shed for engagement in the catcher upon pivoting of the needle into and from the shed.

In still another embodiment, the shaft on which the needle is mounted is rotatable on an axis disposed on an angle to the direction of movement of the warp yarns so that the catcher is able to engage a weft yarn extending from the shed upon pivoting of the needle into and from the shed.

These and other objects and advantages of the invention will become more apparent from the following detailed description taken in conjunction with the accompanying drawings wherein.

Figures 2, 2A, 2B:
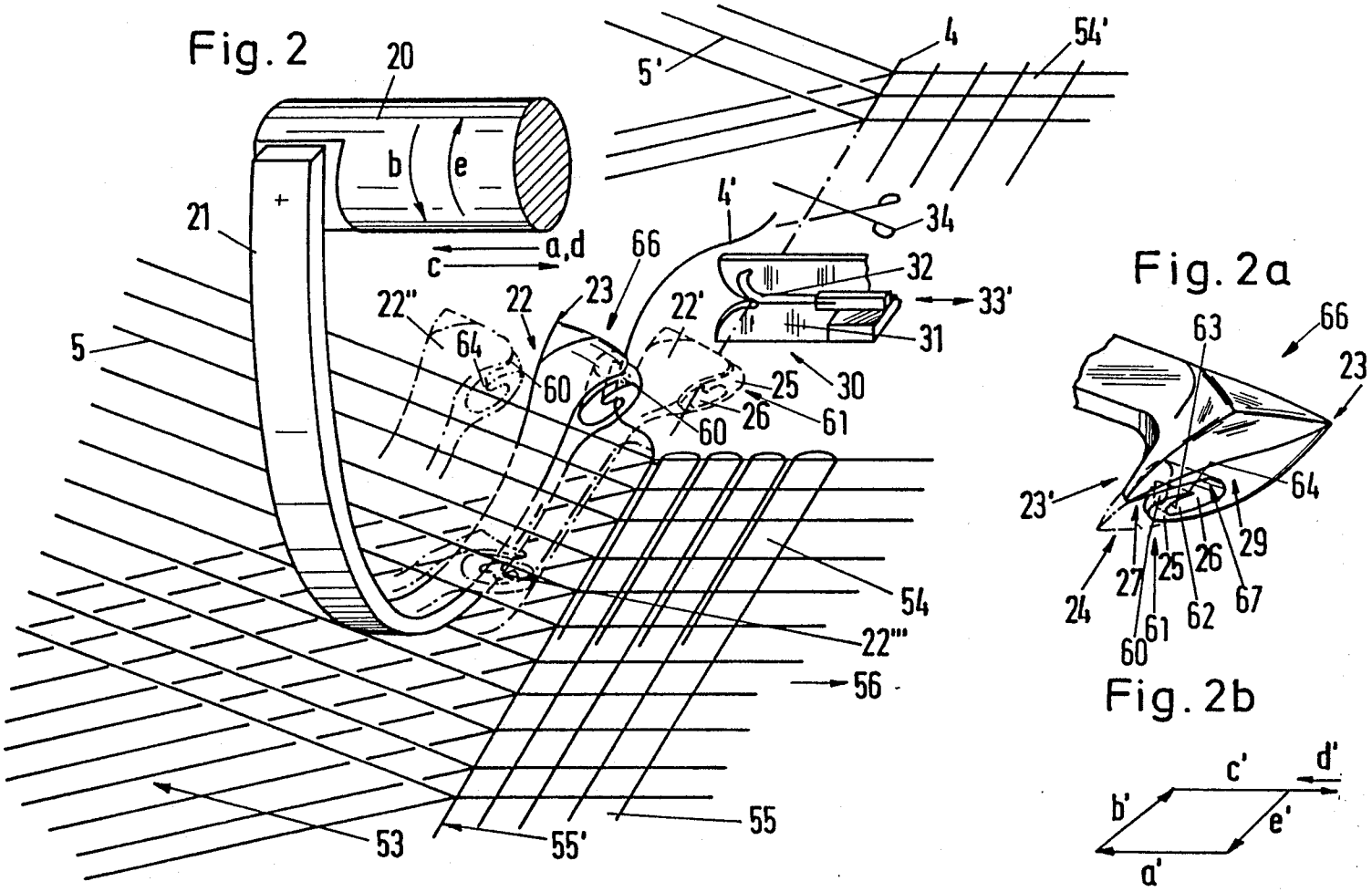
FIG. 2 illustrates a perspective view of a selvage-forming device constructed in accordance with the invention.
Figure 3:
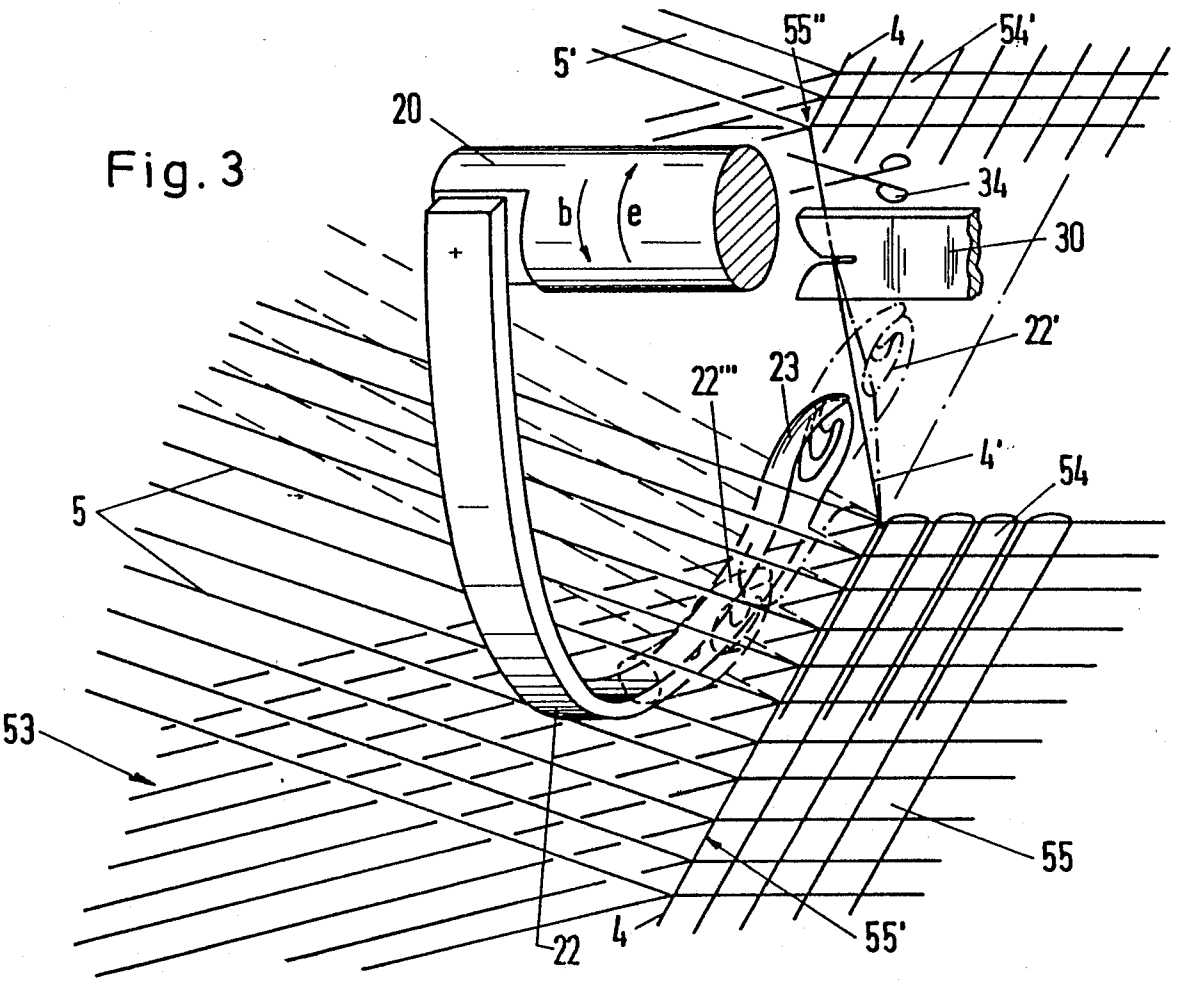
Figure 3B:
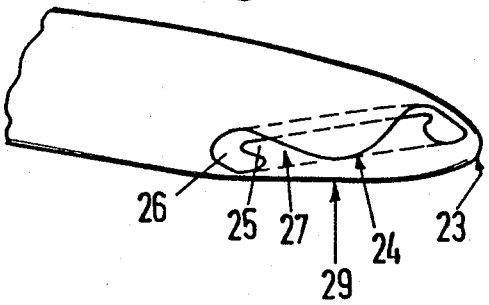
Figure 3A:
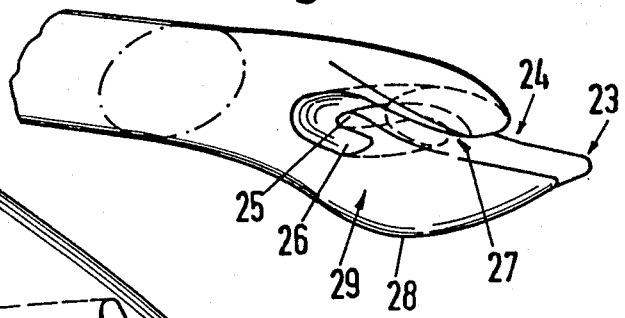
Figure 3C:
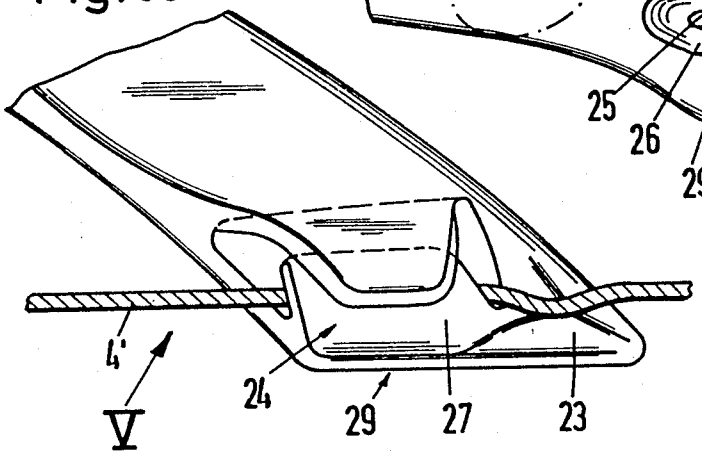
Figure 4:
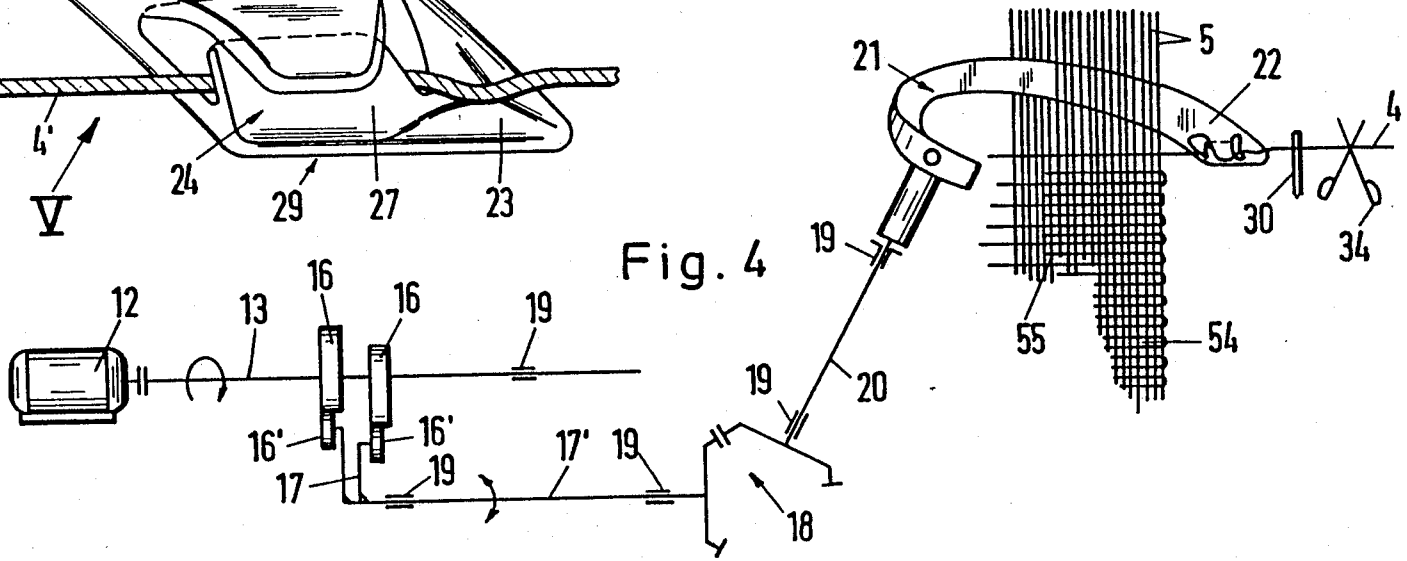
Figure 5:
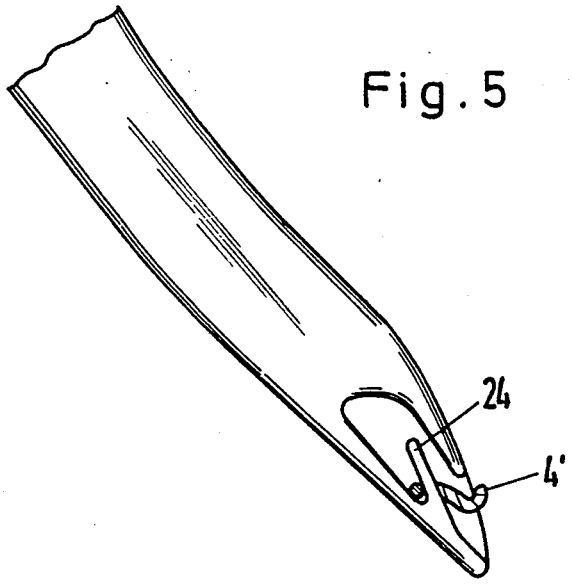
Figure 6:
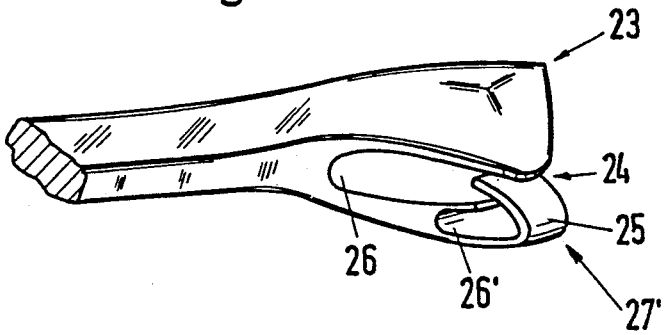
Figure 7:
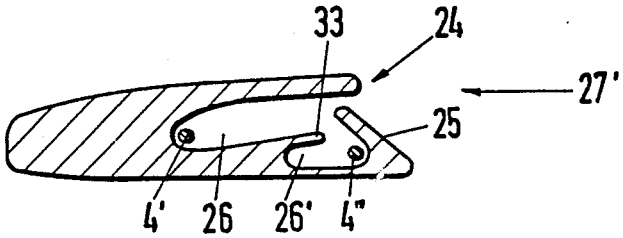
Figure 8:
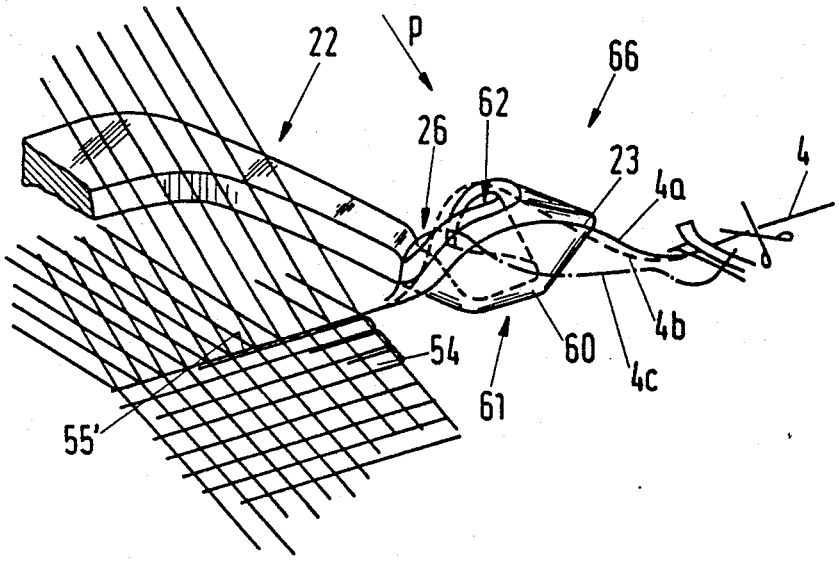
Figure 8A:
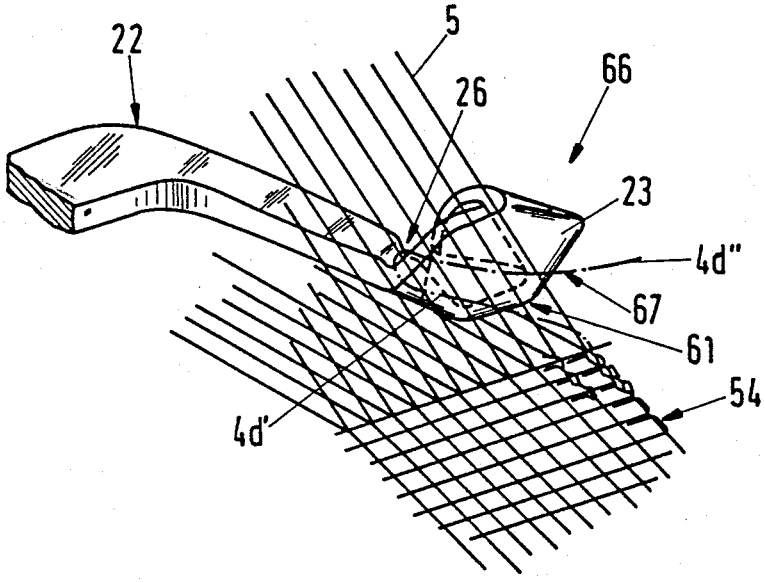
Figure 9A:
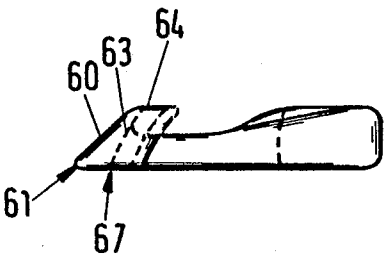
Figure 11:
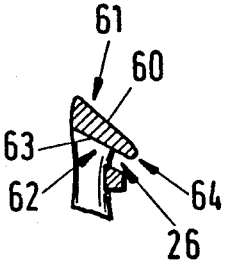
Figure 9:
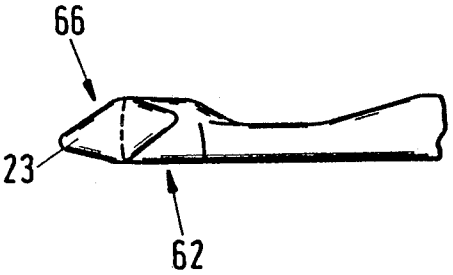
Figure 10:
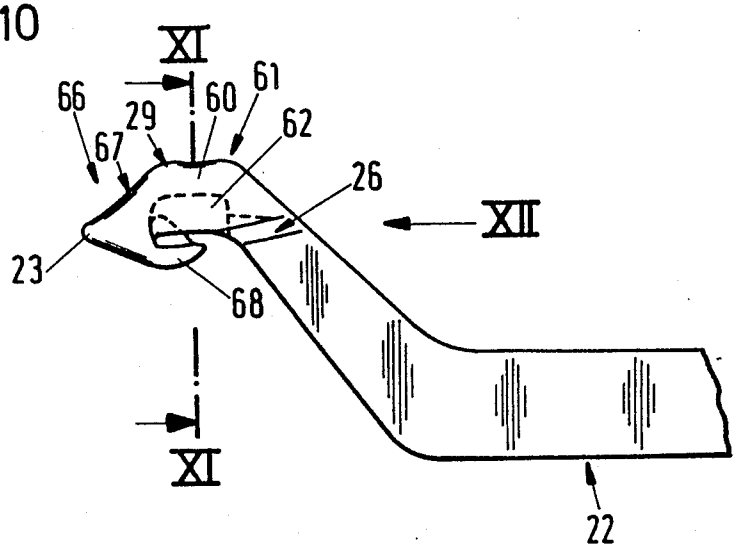
Figure 12:
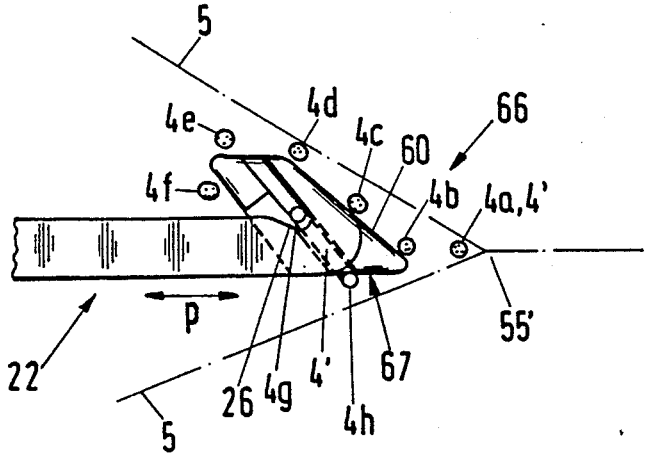
Figure 13:
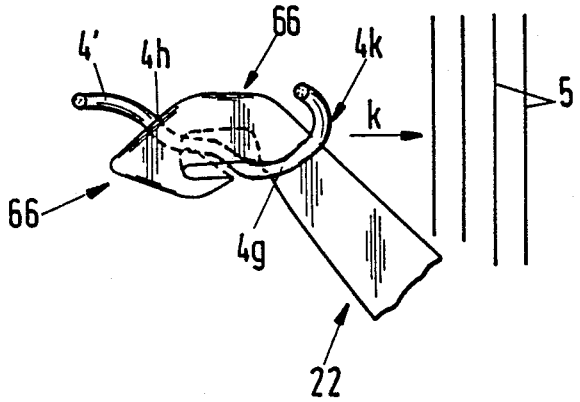
Figures 14, 14A:
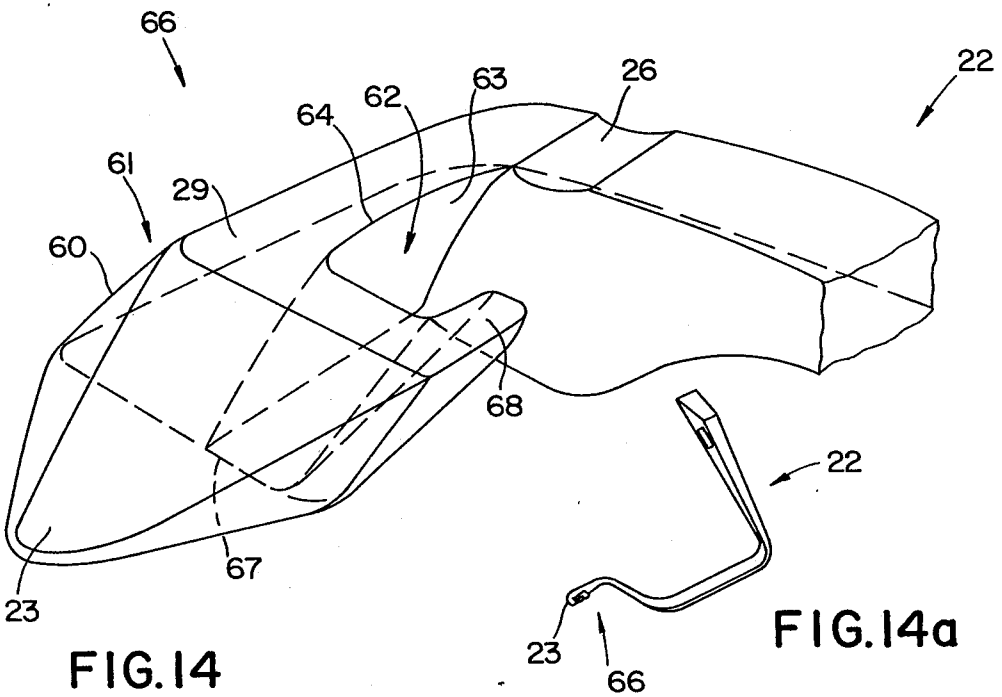

FIG. 2*a* illustrates the distal end of the tuck-in needle of FIG. 2;

FIG. 2*b* graphically illustrates the movement pattern of the tuck-in needle of FIG. 2;

FIG. 3 illustrates a modified tuck-in needle constructed in accordance with the invention;

FIG. 3*a* illustrates a side view of the tuck-in needle of FIG. 3;

FIG. 3*b* illustrates a plan view of the needle end of FIG. 3*a*;

FIG. 3*c* illustrates a modified distal end of a tuck-in needle in accordance with the invention;

FIG. 4 schematically illustrates a selvage-forming device employing an angularly disposed shaft for pivoting of the tuck-in needle in accordance with the invention;

FIG. 5 illustrates a side elevational view of the tuck-in needle of FIG. 3*c* taken in the direction of the arrow V;

FIG. 6 illustrates a further modified tuck-in needle in accordance with the invention;

FIG. 7 illustrates a cross sectional view of the end of the needle of FIG. 6;

FIG. 8 illustrates a further embodiment of a tuck-in needle in a position during engagement of a weft yarn;

FIG. 8*a* illustrates the needle of FIG. 8 during a drawing-in of the weft yarn into a cloth edge;

FIG. 9 illustrates a plan view of a further tuck-in needle in accordance with the invention;

FIG. 9*a* illustrates a side elevation view of the needle of FIG. 9;

FIG. 10 illustrates a side view of the tuck-in needle of FIG. 9;

FIG. 11 illustrates a view taken on line XI—XI of FIG. 10;

FIG. 12 illustrates an elevational view of the needle of FIG. 9 taken in the direction during tucking-in of a weft yarn;

FIG. 13 illustrates a plan view of the tuck-in needle of FIG. 9 during the tucking-in operation;

FIG. 14 illustrates a perspective view of the tip of the tuck-in needle of FIG. 8; and FIG. 14*a* illustrates a perspective view of the tuck-in needle of FIG. 8.

Figure 1:
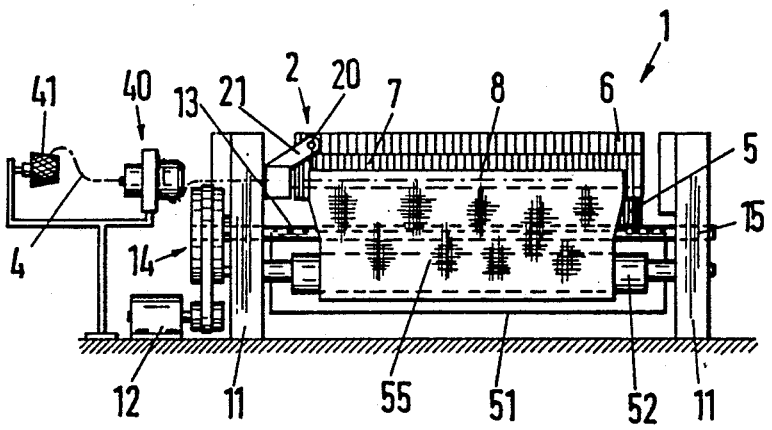
FIG. 1 illustrates a diagrammatic overall view of a loom employing a mechanical selvage-forming device in accordance with the invention.

Referring to FIG. 1, the loom 1 is constructed in a conventional fashion. To this end, the loom 1 includes a drive motor 12 which drives a main drive shaft 13 via a belt drive 14. The drive shaft 13 is journaled in bearings 15 in a frame 11 of the loom 1 and drives, for example, a cloth beam 52 for drawing off cloth 55 or possibly a warp beam 51 which pays off warp yarns 5. The shaft also drives means such as herald frames 6 for forming a plurality of warp yarns 5 into a shed. In addition, a reed 7 is driven off the shaft 13 for beating-up weft yarns 4 drawn in along a picking path 8 between the warp yarns to a cloth fell 55'.

As shown, the weft yarn 4 is supplied from a package 41 to a weft accumulator 40 and is picked, for example by compressed air.

A mechanical selvage-forming device 2 is disposed on each side of the loom 1 to form a selvage in the cloth which is formed. Each such device acts by way of a needle arm 21 secured to a shaft or rod 20 to return to the cloth the weft yarn ends projecting therefrom.

Referring to FIG. 1, wherein like reference characters indicate like parts as above, the shaft 20 of the mechanical self-selvage-forming device is rotatable about a longitudinal axis in opposite directions as indicated by the arrows b, e. In addition, the shaft can be reciprocated longitudinally in the directions indicated by the arrows a, c.

A tuck-in needle 22 is secured to the shaft 20 and has a bent needle arm 21 extending from the shaft 20 for moving into the shed of warp yarns 5. As illustrated, the needle 22 has a tip 23 at the distal end of the arm 21 for passing between two adjacent warp yarns during rotation of the shaft 20 as well as a catcher 24 upstream of the tip 23. As indicated, the tip 23 is disposed on one flank of the needle arm 21 while the catcher 26 is disposed on the opposite flank.

Referring to FIG. 2*a*, the catcher 24 includes an entry zone 27 for initially receiving a weft yarn, a trough 26 for receiving the weft yarn from the entry zone 27 and a hook 25 which extends toward the trough 26 in order to screen the trough 26 from the entry zone 27.

As indicated in FIGS. 2 and 2*a* the head 66 of the needle 22 is shaped such that the hook 25 forms a projection 61 with an inclined ramp 60 for passing under and lifting an end of a weft yarn. At the top of the hook 25, the projection 61 merges by way of an edge 64 (see FIG. 2*a*) into a setback 62. This setback 62 has a boundary wall 63 which extends toward the projection 61. A yarn guide 67 prevents the weft yarn end 4' from sliding out of the catching trough 26. As illustrated, the edge 64 and the boundary wall 63 define an entrance therebetween into the trough 26 for a weft yarn. In addition, the boundary wall 63 and ramp 60 are inclined at acute angles relative to the direction of forward motion of the ramp 60.

Referring to FIG. 2, a yarn clamp 30 is disposed outside of the warp yarns 5 in order to hold the end of a weft yarn 4 extending from the shed of warp yarns 5. In this embodiment, the yarn clamp 30 is stationary although the clamp 30 may be reciprocable in the direction indicated by the arrow 33'. The yarn clamp 30 includes a clamping plate 31 and a clamping spring 32 for engaging the weft yarn 4. In addition, a shears 34 is disposed on a side of the yarn clamp 30 opposite the shed in order to sever the weft yarn 4 as indicated. This shears 34 may also be reciprocable in the direction indicated by the arrow 33'.

Referring to FIG. 2*b*, the path of movement of the shaft 20 and thus, the tuck-in needle is indicated. Thus, a' denotes the axial movement of the shaft 20 into the shed in parallel to the direction of movement of the warp yarns as indicated by the arrow 56 in FIG. 2; b' indicates the rotation of the shaft 20 so as to move the needle 22 into the shed and the movement of the needle tip 23 into the position 22" (see FIG. 2); c' denotes the forward axial movement of the shaft 20 and the movement of the needle tip 23 into the position 22' (FIG. 2) and the simultaneous catching of the weft yarn 4']still retained by the yarn clamp 30; d' denotes a short movement in a direction beyond the cloth fell 55' to ensure engagement of the weft yarn 4 within the trough 26 of the catcher 24; and e' denotes the pivoting movement of the shaft 20 and the drawing-in of the weft yarn end 4'.

During operation, after the picking of the last weft yarn 4 to be picked, the reed 7 (not shown) beats up the yarn on the fell of the cloth 55 while auxiliary warp yarns 5' form an auxiliary edge 54'. The weft yarn 4 is then engaged between the clamping plate 31 and clamping spring 32 of the yarn clamp 30 and severed by the shears 34. In this respect, it may be sufficient for the yarn clamp 30 to be constructed as a centering device without a clamping spring 32.

With the weft yarn end 4' retained by the yarn clamp 30, the rod 20 is pivoted (b') so that the needle arm 21 is introduced into the warp shed 5 with the tip 23 parting two warp yarns followed by the catcher 24. Thereafter, the shaft 20 is moved axially so that the arm 20 undergoes a longitudinal movement (d') towards the weft yarn 4 so that yarn moves into the entry zone 27 of the catcher 24 and comes to be disposed by way of the hook 25 in the trough 26. At this time, the needle 22 is moved into the position 22'. Thereafter, a rearward longitudinal movement of the shaft 20 moves the needle 22 away from the fell 55 and returns the needle 22 into the solid line position parallel to the weft yarn 4. Thereafter, the shaft 20 is moved further axially so that the needle tip 23 is moved to the position 22''' shortly before termination of tucking-in during which the weft yarn end is drawn laterally through the catcher 24. The shaft 20 is then rotated out of the shed while the weft yarn end 4' slides out of the catcher 24 to form a loop (FIG. 2). After a further shedding motion, the weft yarn end is formed into the selvage 54 of the cloth.

The shape of the tuck-in needle thus enables the movement pattern of the needle to be relatively simple.

Referring to FIG. 3, wherein like reference characters indicate like parts as above, the tuck-in needle may be moved in a simple pattern so that the shaft 20 undergoes only a single pivoting movement in order to effect the catching of the weft-yarn end 4' and the drawing-in of the weft yarn end. In this case, the yarn clamp 30 holds the weft yarn 4 extending from the shed in angular relation to the shed for engagement in the catcher of the needle tip 23 upon pivoting of the needle arm into the shed. To this end, the auxiliary edge 54' has a beating-up line 55" set back from the beating-up line 55" of the cloth 55. Because of this offset, when the needle tip 23 is being pivoted into the position 22' to engage the weft yarn end 4', the yarn end is disposed between the selvage 54 and the yarn clamp 30 at an inclination to the direction of needle tip movement.

The selvage-forming device of FIG. 3 requires only a single pivoting movement b in order to enter the shed 53 and to engage the weft yarn end 4'. The weft yarn end 4' can then be tucked-in a pivoting movement e opposite to the pivoting-in movement of the needle 22. If the pivoting movement e is sufficient for the needle tip 23 to move outside the movement zone of the reed 7 during the beating-up of the weft yarn 4, the shaft 20 need not be moved axially as is necessary in the embodiment of FIG. 2.

As illustrated in FIG. 3, the shears 34 and yarn clamp 30 are on the line of the weft yarn end 4' when in the operative positions, respectively.

Referring to FIGS. 3*a* and 3*b*, the needle 22 is shaped to accommodate the pivoting movement indicated in FIG. 3. To this end, as indicated in FIG. 3*a* the needle has a thickening 28 on the flank opposite the catcher 24 to facilitate the formation of a lane between the warp yarns 5 when the needle 22 pivots into the shed. During such pivoting-in, the warp yarns are so displaced as to be unable to move into the entry zone 27 of the catcher 24. In addition, the catcher 24 extends parallel to the position in which the weft yarn end 4' is disposed upon engagement. The catcher 24 is therefor disposed at an obtuse angle to the warp yarns 5 while the needle 22 is pivoting into the shed 53 in order to prevent the warp yarns 5 from catching in the catcher 24.

Referring to FIG. 4, wherein like reference characters indicate like parts as above, the shaft 20 is rotatable on an axis disposed on an angle to the direction of movement of the warp yarns 5 to permit the needle 22 to engage a weft yarn 4 extending from the shed. As above, the shaft 20 is connected to a means for rotating the shaft 20.

As illustrated, the drive means for the shaft 20 is driven off the main shaft 13 which is driven continuously by the drive motor 12. To this end, the shaft 13 has a camming drive on which rollers 16' secured to lever arms 17 run. The arms 17 produce a reciprocating movement of a shaft 17' and a pair of bevel gears 18 transmit this reciprocating movement to the shaft 20. As indicated, suitable bearings 19 are provided for journaling of the shaft 17' and shaft 20.

As also indicated, the auxiliary edge 54', shears 34 and yarn clamp 30 can be retained as in the embodiment of FIG. 2 together with a similar needle 22 since there is no need for the shaft 20 to move axially.

Referring to FIGS. 3*c* and 5, the tuck-in needle 22 utilized in the embodiment of FIG. 4 is similar to that as illustrated in FIG. 3*b*. As indicated in FIGS. 3*c* and 5, the needle tip 23 must be higher than the entry zone 27 in order to ensure that the warp yarns 5 do not catch in the catcher 24 when the needle 22 moves into a shed.

Referring to FIGS. 6 and 7, wherein like reference characters indicate like parts as above, it has been found advantageous with some kinds of yarn to dispose a draw-in trough 26' at the front of the catcher 24. In this case, the draw-in trough 26' is partly separated from the rest of the catcher 24 by a web 33. Of note, FIG. 7 illustrates a sectional view through the needle 23 in a plane extending parallel to the entry direction 27' of a weft yarn. In this case, the trough 26 can be enlarged since the yarn remains in a defined engagement in the position 4' in the trough 26' while being drawn into the selvage.

The advantage of enlarging the trough 26 is that the position of the tuck-in needle 22 need not be adapted accurately to the beating-up line 55' which can be displaced in dependence upon the nature of the yarn and the weave of the cloth. Consequently, the weft yarn end 4', at catching, penetrates relatively far into the trough 26. FIG. 7 shows the rearmost possible position of the weft yarn end 4'. When the tuck-in needle makes a return movement as indicated by the arrow d' in FIG. 2*b* the weft yarn end 4' slides over the separating web 33 into a position 4'' below the hook 25. The weft yarn end 4' remains in this position while being drawn in as indicated by the arrow d' in FIG. 2*b*. This has the advantage that a less twisted yarn is less likely to be untwisted during drawing-in when the yarn passes through a relatively narrow trough 26.

Referring to FIG. 2, the shaft 20 can be driven by any suitable means (not shown) which is capable of rotating the shaft 20 in the directions indicated by the arrows b, e and which is capable of reciprocating the shaft 20 longitudinally in the directions indicated by the arrows a, d, c.

Referring to FIGS. 8 and 8*a* wherein like reference characters indicate like parts as above, the tuck-in needle may also be constructed with a projection 61 which is disposed below the beating-up line 55' when positioned for engagement with a weft yarn 4. When in the extended or stretched position 4*a*, the weft yarn slides up on a ramp 60 on the projection 61 while the tuck-in needle 22 moves, in the direction indicated by an arrow p, towards the weft yarn 4 outside the shed. When in the chain-line position 4*b*, the weft yarn 4 is about to slide down into a setback 62 behind the ramp 60, i.e. downstream of the ramp 60. The needle 22 is then moved back in the direction opposite to that indicated by the arrow p so that the yarn moves into the bottom chain-dotted-line position 4*c*, being disposed in the trough 26.

FIG. 8*a* shows the needle head with the yarn end 4*a* in a position between the warp yarns 5 inside the shed near the cloth edge 54. One arm 4*d*' of the weft yarn 4 enters the needle head 66 above the trough 26 and leaves the needle head 66 below the head 66 at the yarn guide 67. Unlike the embodiment of FIG. 2, in which the weft yarn end forms a loop in a substantially horizontal plane the loop formed by the weft yarn end is, when in the draw-in position of FIG. 8*a*, in an inclined or even vertical plane, the arm 4*d*'' being disposed above the arm 4*d*, and both arms being able to contact the warp yarns. This effect is desirable since, because of a more intensive contact with the warp yarns 5, the weft yarn end 4 is additionally prevented from escaping tuck-in because of its resilience.

Referring to FIGS. 9 to 14*a*, wherein like reference characters indicate like parts as above, the tuck-in needle may also be used for tucking-in a weft yarn at the opposite side (picking side) of a cloth. In this respect, the ramp 60, is shown as a line in FIG. 9*a* and the boundary wall 63 is shown as a chain line. The setback 62 behind the edge 64 can be considered as an inclined perforation through the needle head 66 between the ramp 60 and a rear prolongation or extension 68 on the needle head 66. The setback 62 extends in FIG. 10 by way of the zone of chain lines to the left adjacent the trough 26.

FIG. 12 is an elevation of the tuck-in needle looking in the direction of an arrow XII of FIG. 10. To engage the weft yarn 4*a*, the tuck-in needle 22 moves to the right, as indicated by the arrow p, towards the beating-up line 55'. The weft yarn then slides in positions 4*b*, 4*c*, 4*d* over the ramp 60 and upwardly relative to the needle head 66 until finally sliding by way of the positions 4*e*, 4*f* into the position 4*g* in 27 the catching trough 26. The weft yarn part 4*h* retained by the tuck-in needle towards the weft yarn end is pressed downwards by the yarn guide 67 so that the weft yarn 4 cannot disengage upwardly away from the needle head 66. When drawn in between the warp yarns 5 in the direction indicated by an arrow k in FIG. 13, the wet yarn end 4' slides from the side 4*k* over the needle head 66 and is released at the position 4*h*.

The invention thus provides a mechanical selvage-forming device which is capable of very simple operations in order to effect a selvage-forming operation.

Further, the invention provides a tuck-in needle for a selvage-forming device which is of relatively simple construction.

What is claimed is:

1. A tuck-in needle for a selvage forming device of a loom comprising a tip on one flank of said needle for passing into a space between two adjacent warp yarns; and a catcher for a weft yarn upstream of said tip, said catcher including an entry zone for initially receiving a weft yarn, a trough for receiving the weft yarn from said entry zone and a hook extending towards said trough to screen said trough from said entry zone.

2. A tuck-in needle as set forth in claim 1 further comprising a second tip on a second flank of said needle having said catcher therein.

3. A tuck-in needle as set forth in claim 1 further comprising a bent needle arm having said tip and said catcher on a distal end thereof.

4. A tuck-in needle as set forth in claim 1 which further comprises a web dividing said trough into two zones and extending towards said hook to define a draw-in trough under said hook.

5. A selvage forming device for a loom comprising a shaft; and a bent needle arm extending from said shaft for moving into a shed of warp yarns, said arm having a tip for passing into a space between two adjacent warp yarns during rotation of said shaft and a catcher upstream of said tip, said catcher including an entry zone for initially receiving a weft yarn, a trough for receiving the weft yarn from said entry zone and a hook extending towards said trough to screen said trough from said entry zone.

6. A selvage forming device as set forth in claim 5 which further comprises means connected to said shaft for rotating said shaft and for moving said shaft axially.

7. In combination a loom having means for forming a plurality of warp yarns into a shed, means for picking a weft yarn through said shed and a cloth beam for drawing off cloth; and a selvage forming device on at least one side of said loom, said device having a rotatably mounted shaft and a bent needle arm extending from said shaft for moving into said shed during rotation of said shaft, said arm having a tip for passing into a space between two adjacent warp yarns during rotation of said shaft and a catcher upstream of said tip, said catcher including an entry zone for initially receiving a weft yarn, a trough for receiving the weft yarn from said entry zone and a hook extending towards said trough to screen said trough from said entry zone.

8. The combination as set forth in claim 7 wherein said shaft is rotatable on an axis disposed on an angle to the direction of movement of the warp yarns.

9. The combination as set forth in claim 7 which further comprises a yarn clamp for holding a weft yarn extending from said shed in angular relation to said shed for engagement in said catcher upon pivoting of said arm into said shed.

10. A tuck-in needle for a selvage forming device of a loom comprising an inclined ramp for passing under and lifting an end of a weft yarn extending from a shed;

a setback downstream of said ramp for receiving the weft yarn from said ramp during a forward motion of said ramp; and a trough for catching and receiving the weft yarn from said setback during a rearward motion of said ramp.

11. A tuck-in needle as set forth in claim 10 wherein said ramp has an edge at a top end and said setback has a boundary wall opposite said edge to define an entrance therebetween into said trough for a weft yarn.

12. A tuck-in needle as set forth in claim 11 wherein said boundary wall and said ramp are inclined at acute angles relative to the direction of forward motion of said ramp.

13. A tuck-in needle as set forth in claim 12 which further comprises a yarn guide for retaining the weft yarn in said trough during rearward motion of said ramp.

14. A tuck-in needle as set forth in claim 10 which further comprises a tip on one flank of said needle for passing into a space between two adjacent warp yarns, said ramp being disposed on a second flank of said needle behind said tip.

* * * * *

UNITED STATES PATENT AND TRADEMARK OFFICE

CERTIFICATE OF CORRECTION

PATENT NO. : 4,901,769

DATED : Feb. 20, 1990

INVENTOR(S) : HANS ZOLLINGER

It is certified that error appears in the above-identified patent and that said Letters Patent is hereby corrected as shown below:

On the title page:
In the Abstract, lines 11-12 "enables the tucking-in" should be -enables the movement pattern of the tuck-in needle during catching and tucking-in-
Column 2, line 68 "herald" should be -heald-
Column 4, line 2 "4'] still" should be -4' still-
Column 4, line 59 "tucked-in a" should be -tucked-in in a-
Column 5, line 62 "2b the" should be -2b, the-
Column 6, line 29 "plane the" should be -plane, the-
Column 6, line 32 "4d" shoudl be -4d' -
Column 6, line 57 "in 27 the" should be -in the- Signed and Sealed this Twenty-fifth Day of June, 1991

*Attest:*

*Attesting Officer*

HARRY F. MANBECK, JR.

*Commissioner of Patents and Trademarks*